US008544856B2

(12) United States Patent
Sayre

(10) Patent No.: US 8,544,856 B2
(45) Date of Patent: Oct. 1, 2013

(54) SNOWBLOWER SKID SHOE

(76) Inventor: Robert J. Sayre, Westmont, IL (US)

( * ) Notice: Subject to any disclaimer, the term of this patent is extended or adjusted under 35 U.S.C. 154(b) by 190 days.

(21) Appl. No.: 13/231,031

(22) Filed: Sep. 13, 2011

(65) Prior Publication Data

US 2012/0074662 A1 Mar. 29, 2012

Related U.S. Application Data

(60) Provisional application No. 61/386,529, filed on Sep. 26, 2010.

(51) Int. Cl.
*B62B 17/02* (2006.01)
*E01H 5/06* (2006.01)

(52) U.S. Cl.
CPC ..... *E01H 5/066* (2013.01)
USPC ..... 280/28.17

(58) Field of Classification Search
CPC ..... E01H 5/066; E01H 5/098; B62B 17/02
USPC ..... 280/28.17, 28; 172/387, 393; 244/108
See application file for complete search history.

(56) References Cited

U.S. PATENT DOCUMENTS

| | | | | |
|---|---|---|---|---|
| 1,581,414 | A | 4/1926 | Young | |
| 1,713,882 | A | 5/1929 | Shaw | |
| 1,887,451 | A * | 11/1932 | Dombrowski | 37/270 |
| 2,593,025 | A | 4/1952 | Hanson et al. | |
| 2,611,979 | A | 9/1952 | Weller | |
| 2,768,453 | A | 10/1956 | Adams, Jr. | |
| 3,938,400 | A | 2/1976 | Konyha | |
| 4,125,950 | A | 11/1978 | Mashford | |
| 4,390,151 | A * | 6/1983 | Schneider | 244/108 |
| 4,441,266 | A | 4/1984 | Westimayer | |
| 4,500,766 | A | 2/1985 | Reinhardt | |
| D291,654 | S | 9/1987 | Foster, Jr. | |
| 4,756,102 | A | 7/1988 | Chapman | |
| 5,142,801 | A | 9/1992 | Feller | |
| 5,145,195 | A * | 9/1992 | Campbell et al. | 280/28 |
| 5,410,824 | A | 5/1995 | Pedersen | |
| 6,425,196 | B1 | 7/2002 | Weagley et al. | |
| 7,798,514 | B2 * | 9/2010 | Canaday et al. | 280/609 |
| 2006/0218822 | A1 | 10/2006 | Hosmer | |
| 2011/0085884 | A1 * | 4/2011 | Jackman | 414/800 |
| 2011/0314707 | A1 * | 12/2011 | Raftery | 37/224 |

OTHER PUBLICATIONS

Nov. 24, 2008, Garage Journal Classified posting for Snowblower Shoes, 7 pgs.
Dec. 28, 2009, MyTractorForum.com, posting for Snowblower Heavy Duty Shoes, 10 pgs.
2011 Webpage advertisement for Robalon Snowblower Skid Shoes, 2 pgs.

* cited by examiner

*Primary Examiner* — J. Allen Shriver, II
*Assistant Examiner* — Brian Cassidy
(74) *Attorney, Agent, or Firm* — Brinks Hofer Gilson & Lione

(57) ABSTRACT

A skid shoe for a snowthrower is provided that includes a selected dual-faced, dual-angled approach surface, and an elongate footprint as compared to prior skid shoe devices. The skid shoe includes a runner element and a mounting flange element, each of which has dimensions and contours configured to maximize utility when mounted to a snowthrower. In particular, the skid shoe provides for smoothened operation of a snowthrower moving across uneven surfaces and/or abrupt transitions.

16 Claims, 4 Drawing Sheets

SNOWBLOWER SKID SHOE

CROSS-REFERENCE TO RELATED APPLICATIONS

This application is a non-provisional application which claims priority to U.S. provisional application Ser. No. 61/386,529, filed Sep. 26, 2010, which is incorporated by reference herein in its entirety.

TECHNICAL FIELD

The presently disclosed embodiments relate to snow or ice removing or grooming by portable device. More particularly, the presently disclosed embodiments relate to accessories for a snowthrower machine.

BACKGROUND

Snowthrowers, also known as snowblowers, are machines configured for snow removal. Common embodiments of snowthrowers include walk-behind models designed to be manually pushed by an operator (with or without powered assistance to wheels and/or tracks/treads) and those designed for use as part of or an accessory to an-operator driven riding tractor. The snow-throwing mechanism most commonly includes a "single-stage" or "two-stage" configuration. Single-stage snowthrowers typically use a single impeller (e.g., including a plurality of paddles and/or augers) that both moves snow into a receiving region and dispels it out through a directional discharge passage. Two-stage snowthrowers typically use two structures, with a first auger rotating to break up and move snow to a receiving region where a second impeller (e.g., including one or more paddles) expels the snow through a directional discharge passage. Sometimes, single-stage machines are referred to as "snowthrowers," while two-stage machines are called "snowblowers;" however, the present application uses the terms interchangeably to refer to "single-stage" or "two-stage" configurations. The differences between them are not generally germane to embodiments of the innovative structure disclosed herein.

Both walk-behind and tractor/driven snowthrowers include a receiving region configured as a box-like housing—generally open to the front and bottom but generally enclosed on the top, rear, and lateral sides—where the first (or only) snow-engaging structure rotates to move the snow either directly to a discharge chute (in a single-stage device) or to an impeller/blower housing (in a two-stage device). The lower edges of the lateral sides ride along or near to the ground during operation. This creates a problem when operating the device on uneven surfaces. For example, when operating the device on a sidewalk or driveway, there are often cracks, holes, off-set edges (e.g., between paver units), or other surface irregularities that interfere with smooth operation. For example, when the surface is covered by snow, it is common for the leading edges of the lateral housing sides to collide with the edge of a sidewalk paver panel that is raised up relative to its neighbor (e.g., by weathering, cracking, an underlying tree root) with sufficient force to abruptly stop forward progress of the device. This collision can damage the housing, and may inconvenience or even injure the operator. Even if the uneven surface is not sufficiently offset to stop the device's forward progress, the device and/or the surface can be damaged.

Existing snowthrower devices may include skid plates or skid shoes. However, these are typically designed only to provide for height adjustment of the housing, and to accommodate very slightly irregular surfaces. FIG. 1A illustrates a typical prior art skid shoe 100, including a mounting flange 102 extending perpendicularly upward from a runner 104. The runner 104 includes a single leading lower face 104*a* and a single trailing lower face 104*b*, each of which is oriented at an angle well-exceeding 45° relative to a plane defined by a central runner face 104*c*. This steep-faced construction provides for rough, jarring navigation across offset sidewalk panels and other uneven surfaces. Typical skid shoes of this and other configurations do not exceed about 4-6 inches in total length and have no more than a single leading face and a single trailing face. The leading end and trailing end of the runner of even the best the prior art skids are squared off, which can lead to them getting caught and/or hung up in, for example, chain-link fencing along the side of a sidewalk or driveway being cleared of snow.

As such, there has long been a need for improved snowthrower skid shoes. A variety of designs have been introduced over the past several decades, but each of them suffers from one or more shortcomings as highlighted above, or otherwise.

It may therefore be desirable to provide a snowthrower skid design that provides for smoothed navigation across uneven and even broken or jagged surface transitions, and that also provides a durable structure that will protect and preserve a snowthrower to which it is mounted as well as the surfaces on which it is used, together with adjacent structures.

BRIEF SUMMARY

In one aspect, embodiments of the present invention may include a skid shoe configured for use with a snowthrower. A skid shoe may include a runner having five lower faces oriented at angles configured to provide smoothened transition during operation of a snowthrower as compared to prior art devices. The runner may also include filleted/rounded leading and trailing ends configured to decrease likelihood of undesired interactions with nearby structures during operation.

DETAILED DESCRIPTION

Figure 1A:
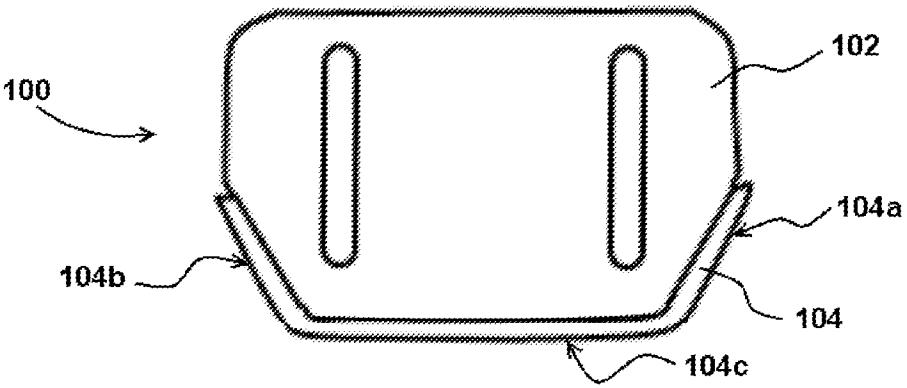
FIG. 1A (Prior Art)
FIG. 1A shows a prior art skid shoe.

Embodiments are described with reference to the drawings in which like elements are generally referred to by like numerals. The relationship and functioning of the various elements of the embodiments may better be understood by reference to the following detailed description. However, embodiments are not limited to those illustrated in the drawings. It should be understood that the drawings are not necessarily to scale, and in certain instances details may have been omitted that are not necessary for an understanding of embodiments of the present invention, such as—for example—conventional fabrication and assembly. With reference to various measurements, phrases such as "at least about one inch" are used herein. This usage is, with reference to the present example, defined throughout (unless specifically excepted) to mean not less than one inch, but including all legal equivalents of one inch or greater than one inch. The concept of legal equivalence for measurements is well-established in the art and under U.S. patent law, such that those of skill in the art will appreciate and comprehend a phrase like "at least about one inch."

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise.

Figure 1B:
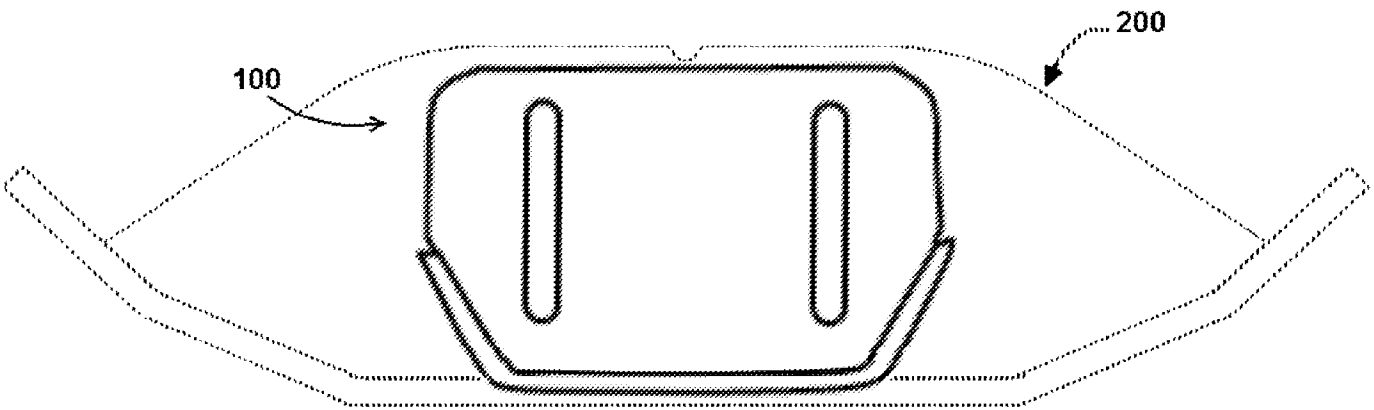
FIG. 1B shows a prior art skid shoe contrasted with the size and contours of one of the presently disclosed embodiments.

One embodiment is illustrated with reference to FIGS. 2A-2B, which show, respectively side view and a top view of a snowthrower skid shoe 200 configured for use with a snowthrower, and especially for use with a walk-behind type of snowthrower. FIG. 1B shows the skid shoe 200 in dotted line to contrast its construction (size and contours, both of which provide key advantages over the prior art) with that of the prior art skid shoe 100. In spite of a long-felt need for smother-operating and more durable skid shoes, evidenced by a variety of products commercially available including somewhat varied skid shoe and even roller-based designs, no other device has provided the advantages afforded by the present design of the skid shoe 200.

The skid shoe 200 includes an elongate runner plate 210 and a mounting flange 230. The mounting flange 220 extends substantially vertically from and upper surface 212 of the runner 210. In preferred embodiments, the mounting flange 230 may be permanently affixed to the runner by welding, molding, or other means. As illustrated in FIG. 2B, the mounting flange 230 is mounted immediately adjacent and parallel with a longer lateral edge 216 of the runner 210. The mounting flange 230 includes a generally octagonal shape that is configured as front-rear symmetrical across a vertical line of symmetry, where six of the shape's apices 231-236 are configured as lower apices contacting the upper surface of the runner plate, and where the other two of the shape's apices 237-238 are configured with filleted radii oriented opposite the upper surface 212 of the runner plate 210.

Figure 2A:
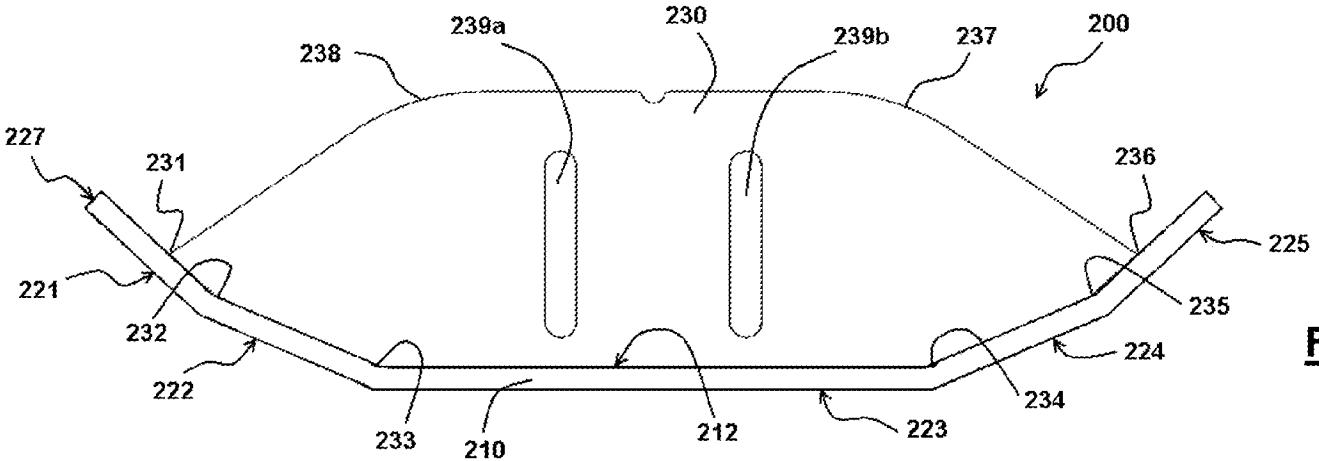
FIG. 2A shows a side view of one embodiment of a skid shoe.

The mounting flange 230 includes a pair of mounting apertures 239*a*, 239*b* transversely disposed through the thickness of the flange 230. The mounting apertures 239*a*, 239*b* preferably are disposed to correspond to mounting attachment structures of a snowthrower. The size, position, number, and orientation of the mounting apertures may be varied to fit different models of snow throwers. This variability may be customized to provide a predetermined number (usually at least two) of apertures. Alternatively, or in addition, a mounting flange may be provided with a greater plurality of apertures, such as the mounting flange 330 of the skid shoe 300 shown in FIG. 3. The mounting flange 330 includes five mounting apertures 339*a*-*e*, which may be spaced and oriented to complement mounting structures such as, for example, mounting bolts on a snowthrower's front housing. In all other aspects, the embodiment of FIG. 3 is generally similar to the size and proportion of embodiments described herein with reference to FIGS. 2A and 2B.

The elongate runner plate 210 preferably is constructed with substantially uniform thickness along its entire length. A lower surface of the runner 210 is disposed opposite the thickness from the upper surface 212, and the lower surface includes at least five contiguous lower faces configured as a first leading face 221, a second leading face 222, an intermediate face 223, a first trailing face 224, and a second trailing face 225. Each of the first leading face 221 and the second trailing face is offset by a first angle, less than 45° from a plane continuous with the intermediate face 223. Each of the second leading face 222 and the first trailing face 224 is vertically offset by a second angle, less than about 30° from the plane continuous with the intermediate face 223. A longitudinal end terminus 227 of the first leading face 221 is vertically perpendicularly offset from the plane continuous with the intermediate face by at least about two inches. This combination of angles and elevation provides a superior approach (from both ends of the skid) to smoothly navigate a snowthrower over even very uneven surfaces and transitions. The at least two-inch elevation, combined with the dual-faced, dual-angled construction described here has been found to provide a clear and surprising advantage over prior art skid shoes, while providing a skid shoe that is useful in size, affordable in construction, and that provides aesthetically pleasing curves in its construction that are also functional as they lessen the likelihood of the skid shoe getting hung up on or otherwise interacting in an undesirable manner with adjacent structures during operation.

The first leading face 221 is substantially symmetrical in size with and is substantially a mirror image of the second trailing face 225. In certain embodiments, the first angle may be configured between about 40° and about 44°, and in a particular embodiment may be configured about 43°. In certain embodiments, the second angle may be configured between about 21° and about 25°, and in a particular embodiment may be configured about 23°.

Figure 2B:
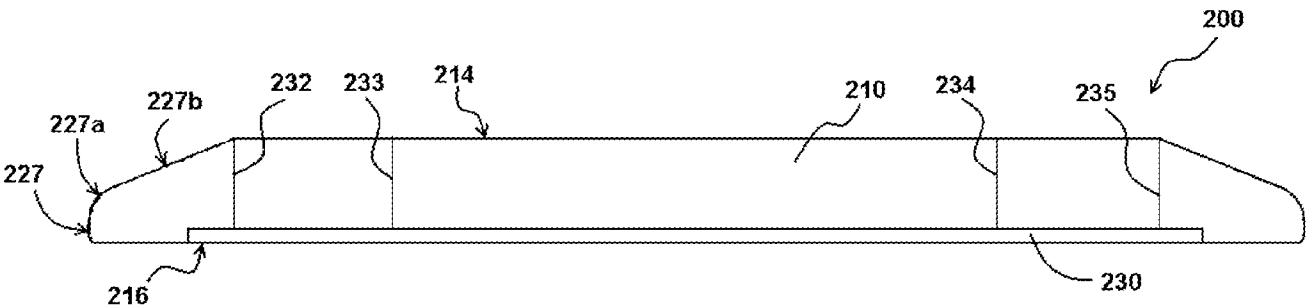
FIG. 2B shows a top view of the embodiment of FIG. 2A.
Figure 3:
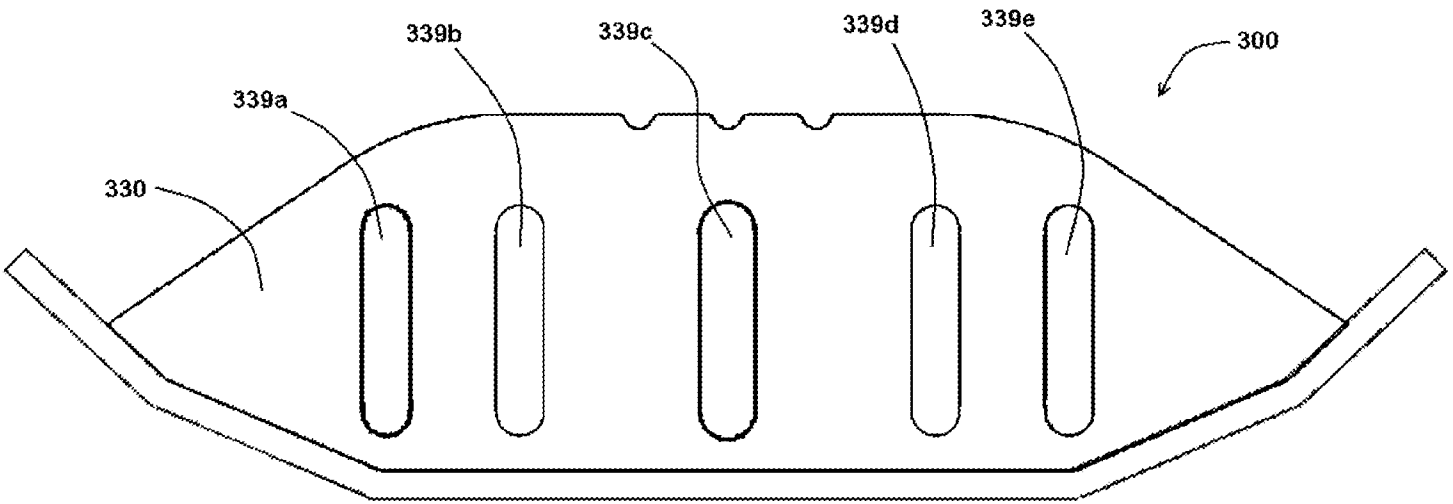
FIG. 3 shows a side view of another embodiment of a skid shoe.

As shown in the top view of FIG. 2B, the runner 210 includes a first lateral edge 214 defining a longitudinal side of the runner plate 210, where the first lateral edge is disposed opposite and generally parallel with a second lateral edge 216. A transition between the first lateral edge 214 and the second lateral edge 216 across the end terminus 227 includes an asymmetrical filleted radius such that a generally rounded portion 227*a* of the transition including the end terminus is nearer the mounting flange 230 than a generally straight portion 227*b* of the transition. This filleted radius construction of the runner ends provides for safety and ease of use in several ways. The structure allows the leading face angles without presenting outside-edge corners that are likely to snag and/or damage a nearby structure (e.g., chain-link fence, wood fence, vehicle tire, or even an operator's feet/legs/boots).

Figure 4:
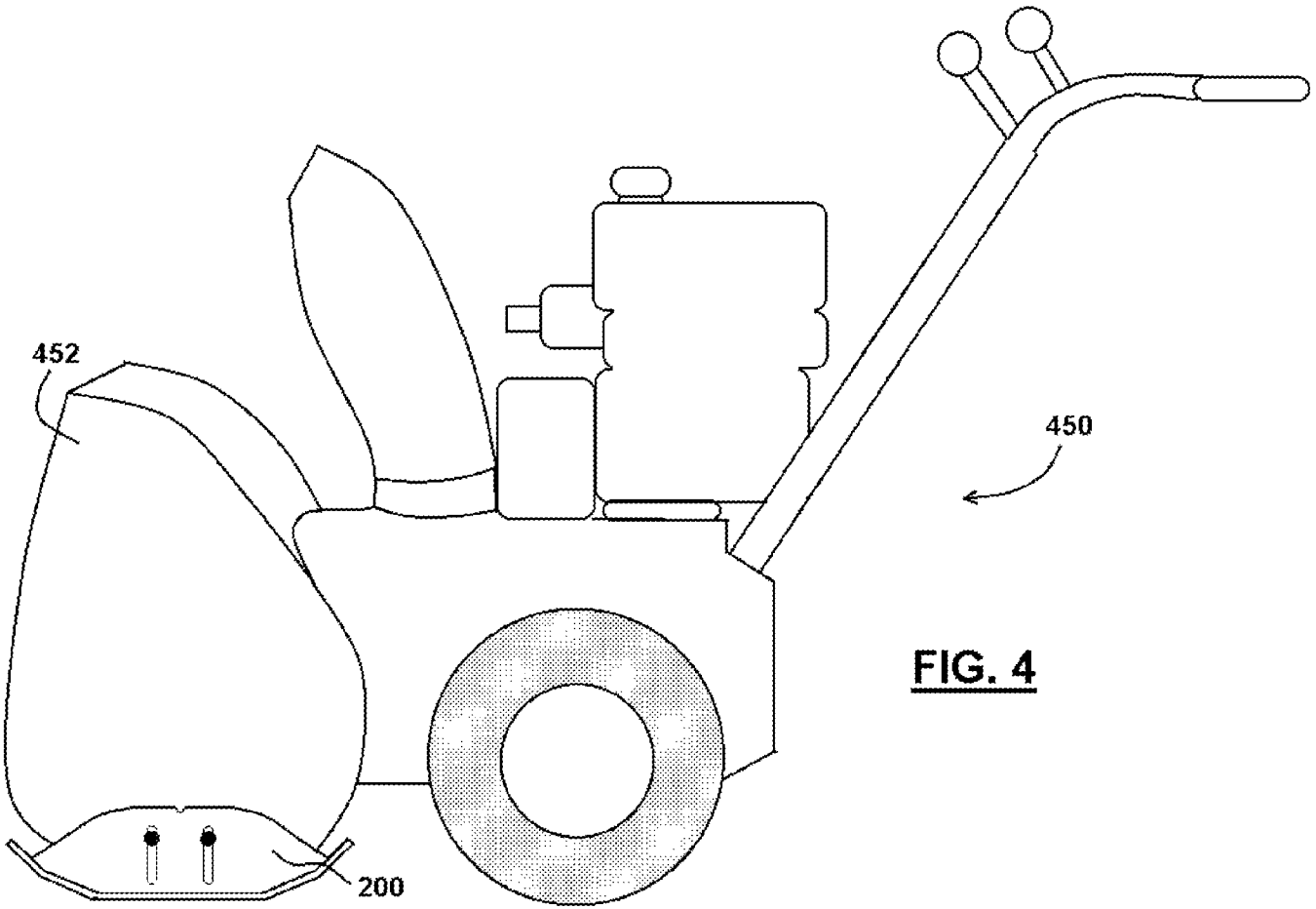
FIG. 4 shows a skid shoe embodiment of FIG. 2 mounted onto a snowthrower.

One example of a specific embodiment is described here with reference to FIGS. 2A, 2B, and 4. This exemplary embodiment is non-limiting with respect to variants that may be practiced within the scope of the present claims. In this embodiment, the runner 210 has a total length of at least about 13 inches (about 33 cm), with a linear length accounting for the bends therein of at least about 12 inches (about 30 cm). The runner 210 is substantially uniformly at least about one-quarter inch (about 0.6 cm) thick along its entire length, about 1⅛ inches (about 2.9 cm) wide (although other runner embodiments may be narrower to reduce surface area drag, such as an embodiment that is about ¾ to about ⅞ inches wide), and is constructed of steel coated with a corrosion-resistant material such as powder coat or enamel. The first, shorter lateral edge 214 has a total length of at least about 9.9 inches (about 25 cm), and the second, longer lateral edge 216 has a total length of about 13 inches (about 33 cm). The generally straight portion 227*b* of the transition between the lateral edges 214, 216 is about 1.4 inches (about 3.5 cm) long and is contiguous with and disposed about 22° offset from the first lateral edge 214, and the rounded portion 227*a* of the transition includes a curvature radius of about 0.4 inches (about 1 cm). Other corrosion-resistant construction materials and/or finish coatings may be used within the scope of the claims for construction of the mounting flange and/or runner. For example, stainless steel or other corrosion-resistant alloys may be used. Whether or not a corrosion-resistant alloy is used, a corrosion-resistant finish may be provided on one or more surfaces.

In this exemplary embodiment, each of the first leading face 221 and second trailing face 225 is about 1.6 inches (about 4 cm) long, each of the second leading face 222 and first trailing face 224 is about 1.9 inches (about 4.8 cm) long, and the intermediate face 223 is about 6 inches (about 15 cm) long. The first leading face 221 and the second trailing face 225 each is configured at about a 43° angle relative to a plane contiguous with the intermediate face 223. The second leading face 222 and the first trailing face 224 each is configured at about a 23° angle relative to the plane contiguous with the intermediate face 223. This construction provides for the leading end terminus 227 to be elevated at least about two inches above to the plane contiguous with the intermediate face 223.

The mounting flange 230 is also constructed of steel, at least about ⅛ inch (about 0.3 cm) thick coated with a corrosion resistant material with two vertical obround mounting apertures 239*a*, 239*b* spaced apart about 2 inches (about 5 cm) center-to-center. The mounting flange 230 is affixed by a permanent weld to, and oriented substantially perpendicular from, the runner's upper surface 212, where it is aligned flush along the second lateral edge 216. The mounting flange 230 has a generally octagonal shape that is configured as front-rear symmetrical across a vertical line of symmetry, where six of the shape's apices 231-236 are configured as lower apices 231-236 contacting the upper surface 212 of the runner plate 210, and where the other two of the shape's apices 237, 238 are configured with filleted radii (each having about a 2.5 inch (about 6.4 cm) radius of curvature) oriented opposite the upper surface of the runner plate.

Each of a leading mounting flange edge (between the leading apices 231, 238) and a trailing flange edge (between the trailing apices 236, 237) is oriented at about a 34° angle relative to the plane continuous with the intermediate face 223. A top edge of the mounting flange between the two apices 237, 238 configured with filleted radii is substantially parallel with the plane continuous with the intermediate face 223. This construction provides for a ready fit with the outer contours of many common snowthrower models, and also provides for minimal likelihood of getting caught on nearby objects during use when mounted to a snowthrower.

FIG. 4 shows the skid shoe 200 mounted onto an auger housing 452 of a snowthrower 450 (illustrated in oversimplified form). It should be appreciated that a second skid shoe 200 constructed essentially as a mirror image may be provided for mounting on an opposite side of the auger housing 452. When mounted as shown, the skid shoe 200 will provide superior navigability for the snowthrower—particularly across rough terrain and abrupt transitions such as, for example, offset sidewalk panels. The sizes, proportions, and angles of the components described herein each may contribute in a critical manner to the advantages presented by the embodiments described.

Those of skill in the art will appreciate that embodiments not expressly illustrated herein may be practiced within the scope of the present invention, including that features described herein for different embodiments may be combined with each other and/or with currently-known or future-developed technologies while remaining within the scope of the claims presented here. Although specific terms are employed herein, they are used in a generic and descriptive sense only and not for purposes of limitation. It is therefore intended that the foregoing detailed description be regarded as illustrative rather than limiting. And, it should be understood that the following claims, including all equivalents, are intended to define the spirit and scope of this invention. Furthermore, the advantages described above are not necessarily the only advantages of the invention, and it is not necessarily expected that all of the described advantages will be achieved with every embodiment of the invention.

I claim:

1. A snowthrower skid shoe configured for use with a snowthrower, the skid shoe comprising:

an elongate runner plate with an upper surface and a lower surface, where the lower surface includes:

at least five contiguous lower faces configured as a first leading face, a second leading face, and intermediate face, a first trailing face, and a second trailing face;

where each of the first leading face and the second trailing face is offset by a first angle, where the first angle is about 43°, from a plane continuous with the intermediate face;

where each of the second leading face and the first trailing face is vertically offset by a second angle, where the second angle is about 23°, from the plane continuous with the intermediate face;

where a longitudinal end terminus of the first leading face is vertically perpendicularly offset from the plane continuous with the intermediate face by about two inches;

a first lateral edge defining a longitudinal side of the runner plate, where the first lateral edge is disposed opposite and generally parallel with a second lateral edge; and a mounting flange extending substantially vertically from the upper surface, the mounting flange disposed immediately adjacent one of the first lateral edge or the second lateral edge;

where a transition between the first lateral edge and the second lateral edge, including the end terminus includes an asymmetrical filleted radius such that a generally rounded portion of the transition including the end terminus is latitudinally nearer to the mounting flange than to a generally straight portion of the transition.

2. The snowthrower skid shoe of claim 1, where the runner plate includes a linear length of at least 12 inches.

3. The snowthrower skid shoe of claim 1, where the runner plate includes a total length along all five faces of at least 13 inches.

4. The snowthrower skid shoe of claim 1, where the runner plate comprises a substantially uniform thickness between the upper surface and the lower surface.

5. The snowthrower skid shoe of claim 4, where the runner plate comprises steel material and substantially uniform thickness is about one-quarter inch.

6. The snowthrower skid shoe of claim 1, further comprising at least two mounting apertures disposed transversely through the mounting flange plate.

7. The snowthrower skid shoe of claim 1, further comprising more than two mounting apertures disposed transversely through the mounting flange plate, said mounting apertures disposed to correspond to mounting attachment structures of a snowthrower.

8. The snowthrower skid shoe of claim 1, where the mounting flange is permanently affixed to the runner plate.

9. The snowthrower skid shoe of claim 1, where the first leading face is substantially symmetrical in size with and is substantially a mirror image of the second trailing face.

10. The snowthrower skid shoe of claim 1, where the transition's generally straight portion is contiguous with and disposed about 22° offset from one of the first lateral edge and the second lateral edge, and where a curved portion of the filleted radius is contiguous with the other of the first lateral edge and the second lateral edge.

11. The snowthrower skid shoe of claim 1, comprising a corrosion-resistant finish.

12. The snowthrower skid shoe of claim 1, where the runner, the mounting flange, or both comprise a corrosion-resistant metal material.

13. The snowthrower skid shoe of claim 1, where each of the first leading face and the second trailing face is about 1.6 inches long, each of the second leading face and first trailing face is about 1.9 inches long, and the intermediate face is about 6 inches long and about 1⅛ inches wide.

14. The snowthrower skid shoe of claim 1, where the mounting flange comprises a generally octagonal shape that is configured as front-rear symmetrical across a vertical line of symmetry, where six of the shape's apices are configured as lower apices contacting the upper surface of the runner plate, and where the other two of the shape's apices are configured with filleted radii oriented opposite the upper surface of the runner plate.

15. The snowthrower skid shoe of claim 14, where each of a leading mounting flange edge and a trailing flange edge is oriented at about a 34° angle relative to the plane continuous with the intermediate face, and where a top edge of the mounting flange between the two apices configured with filleted radii is substantially parallel with the plane continuous with the intermediate face.

16. A snowthrower comprising a skid shoe according to claim 1.

* * * * *